US007017648B2

(12) United States Patent
Newcomb et al.

(10) Patent No.: US 7,017,648 B2
(45) Date of Patent: Mar. 28, 2006

(54) MOLD DESIGN FOR CASTINGS REQUIRING MULTIPLE CHILLS

(75) Inventors: Thomas P. Newcomb, Defiance, OH (US); Edward C. Wall, Midland, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/924,557

(22) Filed: Aug. 24, 2004

(65) Prior Publication Data

US 2006/0042774 A1 Mar. 2, 2006

(51) Int. Cl.
*B22D 15/02* (2006.01)
*B22D 15/04* (2006.01)

(52) U.S. Cl. ..... 164/355; 164/127

(58) Field of Classification Search ..... 164/127, 164/352–357, 371; 249/111
See application file for complete search history.

(56) References Cited

U.S. PATENT DOCUMENTS

| | | | | |
|---|---|---|---|---|
| 5,419,792 | A | 5/1995 | King et al. | |
| 5,533,563 | A | 7/1996 | Lee, Sr. | |
| 5,704,412 | A * | 1/1998 | Gurdebeke | 164/127 |
| 5,730,200 | A | 3/1998 | Landua | |
| 6,394,793 | B1 | 5/2002 | Bunge | |
| 6,598,655 | B1 | 7/2003 | Newcomb et al. | |
| 6,615,901 | B1 | 9/2003 | Kaminski et al. | |
| 2002/0185249 | A1 * | 12/2002 | Singer et al. | 164/137 |
| 2003/0000677 | A1 | 1/2003 | Arcelus et al. | |
| 2003/0217831 | A1 | 11/2003 | Arcelus et al. | |
| 2004/0200596 | A1 * | 10/2004 | Herron et al. | 164/127 |

* cited by examiner

*Primary Examiner*—Kuang Y. Lin
(74) *Attorney, Agent, or Firm*—Charles H. Ellerbrock

(57) ABSTRACT

A mold design is disclosed for precision sand casting of engine cylinder blocks, such as engine cylinder V-blocks, having chills disposed therein, wherein an expansion and contraction caused by changes in temperature during the casting operation are accommodated by the chills.

19 Claims, 4 Drawing Sheets

MOLD DESIGN FOR CASTINGS REQUIRING MULTIPLE CHILLS

FIELD OF THE INVENTION

The invention relates to a mold design and more particularly to the mold design for precision sand casting of engine cylinder blocks, such as engine cylinder V-blocks, having chills disposed therein.

BACKGROUND OF THE INVENTION

In a sand casting process of an internal combustion engine cylinder block, an expendable mold package is assembled from a plurality of resin-bonded sand cores (also known as mold segments) that define the internal and external surfaces of the engine block. Typically, each of the sand cores is formed by blowing resin-coated foundry sand into a core box and curing it therein.

Traditionally, the mold assembly method involves positioning a base core on a suitable surface and building up or stacking separate mold elements to shape such casting features as the sides, ends, valley, water jacket, cam openings, and crankcase. Additional cores may be present as well depending on the engine design.

Removal of thermal energy from the liquid metal in the mold package is an important consideration in the foundry process. Rapid solidification and cooling of the casting promotes a fine grain structure in the metal leading to desirable material properties such as high tensile and fatigue strength, and good machinability. For engine designs with highly stressed bulkhead features, the use of a thermal chill may be necessary. The chill is much more thermally conductive than foundry sand and readily conducts heat from those casting features it contacts. The chill typically consists of one or more steel or cast iron bodies assembled in the mold in a manner to shape some portion of the features of the casting. The chills may be placed into the base core tooling and a core formed about them, or they may be assembled into the base core or between the crankcase cores during mold assembly.

In some casting processes, metals and metal alloys are being used which differ from the metals used to form the chills. Thus, thermal expansion characteristics differ between the chills and the metal being used in the casting process. Further, the chills become larger following pouring of the metal, while the casting contracts as it cools. This results in relative movement between the metal chills and the casting.

It would be desirable to produce a mold for sand casting of engine cylinder blocks having chills wherein an expansion of a chill and a contraction of a casting caused by changes in temperature following a mold filling operation are accommodated by the chills without damage to the chill or the casting.

SUMMARY OF THE INVENTION

Consistent and consonant with the present invention, a mold for sand casting of engine cylinder blocks having chills wherein an expansion of a chill and a contraction of a casting caused by changes in temperature following a mold filling operation are accommodated by the chills without damage to the chill or the casting, has surprisingly been discovered.

In one embodiment, the mold for sand casting of engine cylinder blocks comprises a chill plate adapted to be assembled into a mold package; and at least one chill supported by the chill plate to allow relative movement therebetween to facilitate variable positioning of the chill to accommodate expansion and contraction between the chill, the chill plate, and a casting due to temperature fluctuations during a casting process, the chill selectively cooling a portion of the casting.

In another embodiment, the mold comprises a chill plate adapted to be assembled into a mold package; a chill supported by the chill plate for selectively cooling a portion of a casting; and a spring disposed between the chill plate and the chill to support the chill to permit relative movement between the chill and the chill plate to facilitate variable positioning of the chill to accommodate expansion and contraction between the chill, the chill plate, and the casting due to temperature fluctuations during a casting process.

In another embodiment, the mold comprises a chill plate; a mold carrier plate disposed on the chill plate, the mold carrier plate having an aperture formed therein; a base core supported by the mold carrier plate and adapted to support a core package therein; a cover core supported by the base core and cooperating with the base core to enclose the core package therein; a chill supported by the chill plate for selectively cooling a portion of a casting, the chill extending through the aperture to contact the casting, a spring disposed between the chill plate and the chill to support the chill to allow relative movement between the chill and the chill plate to facilitate variable positioning of the chill to accommodate expansion and contraction between the chill, the chill plate, and the casting due to temperature fluctuations during a casting process.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
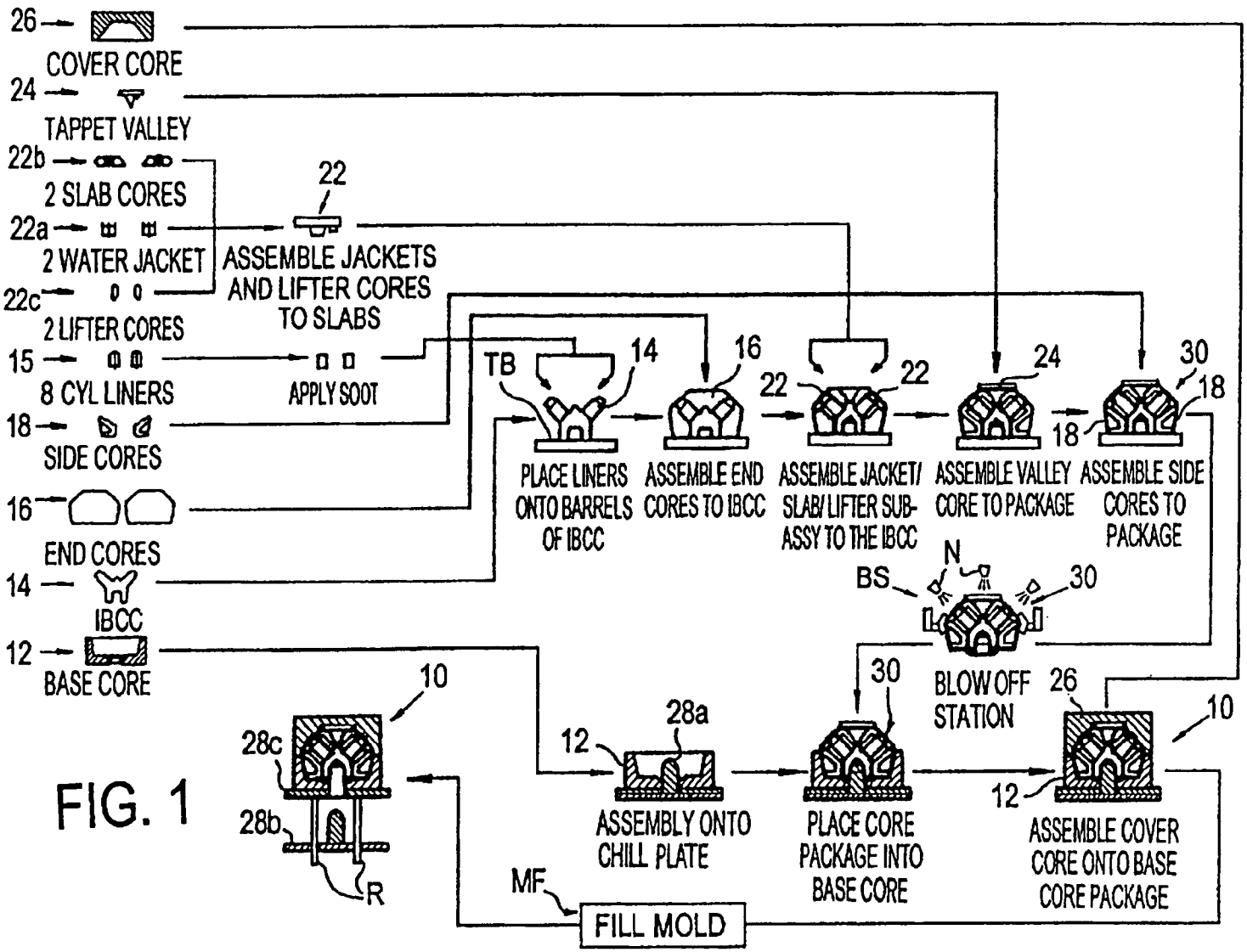
FIG. 1 is a flow diagram showing an assembly process for an engine V-block mold package with the front end core omitted for clarity.

FIG. 1 depicts a flow diagram showing a sequence for assembling an engine cylinder block mold package 10. The invention is not limited to the sequence of assembly steps shown as other sequences can be employed to assemble the mold package. For purposes of illustration, and not limitation, a core for an eight-cylinder V-type engine is shown. It is understood that more or fewer cylinders can be used and that other engine cylinder configurations can be used according to the invention without departing from the scope and spirit thereof. It is also understood that the features of the invention could be used with other core types. In the embodiment shown, a resin bonded sand core is used.

The mold package 10 is assembled from resin-bonded sand cores including a base core 12 mated with a crankcase chill 28*a*, a chill plate 28*b*, and a mold carrier plate 28*c*, an integral barrel crankcase core (IBCC) 14 having a metal cylinder bore liner 15 thereon such as cast iron, aluminum, or aluminum alloy, for example, two end cores 16, two side cores 18, two water jacket slab core assemblies 22, a tappet valley core 24, and a cover core 26. The water jacket slab core assembly 22 includes a water jacket core 22*a*, a jacket slab core 22*b*, and a lifter core 22*c*. The cores 12, 14, 16, 18, 22, 24, 26 described above are offered for purposes of illustration and not limitation as other types of cores and core configurations may be used in assembly of the engine cylinder block mold package 10 depending upon the particular engine block design to be cast. For illustrative purposes, only a crankcase chill 28*a* has been shown in FIG. 1, however, it is understood that other chill types can, and typically are, used as desired. The use of chills in a casting process such as that described herein facilitates forming of a desired grain structure in cast metal parts.

The resin-bonded sand cores can be made using conventional core-making processes such as a phenolic urethane cold box or Furan hot box where a mixture of foundry sand and resin binder is blown into a core box and the binder cured with either a catalyst gas and/or heat. The foundry sand can comprise silica, zircon, fused silica, and others.

The cores 14, 16, 18, 22, 24 initially are assembled apart from the base core 12 and cover core 26 to form a subassembly or core package 30 of multiple cores. The cores 14, 16, 18, 22, 24 are assembled on a temporary base or member TB that does not form a part of the final engine block mold package 10.

The subassembly 30 and the temporary base TB are separated by lifting the subassembly 30 off of the temporary base TB at a separate station. The temporary base TB is returned to the starting location of the subassembly sequence where a new integral barrel crankcase core 14 is placed thereon for use in assembly of another subassembly 30.

The subassembly 30 is taken to a cleaning station or blow-off station BS, where the subassembly 30 is cleaned to remove loose sand from the exterior surfaces of the subassembly 30 and from interior spaces between the cores 12, 16, 18, 22, 24, 26 thereof. The loose sand typically is present as a result of the cores rubbing against one another at the joints therebetween during the subassembly sequence. A small amount of sand can be abraded off of the mating joint surfaces and lodge on the exterior surfaces and in narrow spaces between adjacent cores where its presence can contaminate the engine block casting made in the mold package 10.

The blow-off station BS typically includes a plurality of high velocity air nozzles N which direct high velocity air on exterior surfaces of the subassembly 30 and into the narrow spaces between adjacent cores 12, 16, 18, 22, 24, 26 to dislodge any loose sand particles and cause the sand to be blown out of the subassembly 30. In lieu of, or in addition to, moving the subassembly 30, the nozzles N may be movable relative to the subassembly 30 to direct high velocity air at the exterior surfaces of the subassembly 30 and into the narrow spaces between adjacent cores 12, 16, 18, 22, 24, 26. It is understood that other cleaning methods can be used as desired such as the use of a vacuum cleaning station, for example.

The cleaned subassembly 30 is positioned on base core 12 residing on the chill plate 28*b*. Chill plate 28*b* includes the mold stripper plate 28*c* disposed on the chill plate 28*b* to support the base core 12. The base core 12 is placed on the mold carrier plate 28*c* with the crankcase chill 28*a* disposed on the chill plate 28*b*. The crankcase chill 28*a* can be produced from an assembly or formed as a unitary structure. The crankcase chill 28*a* extends through an opening formed in mold carrier plate 28*c* and an opening formed in the base core 12 into a cavity formed in the core 14. The chill plate 28*b* includes apertures through which lifting rods R extend which facilitate separating the crankcase chill 28*a* from the mold carrier plate 28*c* and mold package 10. The crankcase chill 28*a* can be made of cast iron or other suitable thermally conductive material to rapidly remove heat from the bulkhead features of the casting, the bulkhead features being those casting features that support the engine crankshaft via the main bearings and main bearing caps. The chill plate 28*b* and the mold carrier plate 28*c* can be constructed of steel, thermal insulating ceramic plate material, combinations thereof, or other durable material. The function of the chill plate 28*b* is to facilitate the handling of the crankcase chill 28*a* and other chills, and the function of the mold carrier plate 28*c* is to facilitate the handling of the mold package 10. The chill plate 28*b* and the mold carrier plate 28*c* typically are not intended to play a significant role in extraction of heat from the casting, however.

The cover core 26 is placed on the base core 12 and subassembly 30 to complete assembly of the engine block mold package 10. Additional cores (not shown) which are not part of the subassembly 30 can be placed on or fastened to the base core 12 and the cover core 26 as desired before being moved to the assembly location where the base core 12 and the cover core 26 are united with the subassembly 30. For example, the subassembly 30 can be assembled without side cores 16, which instead are assembled on the base core 12. The subassembly 30 without side cores 16 is subsequently placed in the base core 12 having side cores 16 thereon.

The completed engine block mold package 10 is moved to a mold filling station MF, where the mold package 10 is filled with molten metal such as molten aluminum, for example. Any suitable mold filling technique may be used to fill the mold package 10 such as gravity pouring or electromagnetic pump, for example.

After a predetermined time following casting of the molten metal into the mold package 10, the mold package 10 is moved to a station where the lift rods R are inserted through the holes of chill plate 28*b* to raise and separate the mold carrier plate 28*c* with the cast mold package 10 thereon from the chill plate 28*b*. The chill plate 28*b* can be returned to the beginning of the assembly process for reuse in assembling another mold package 10. The cast mold package 10 can be further cooled on the mold carrier plate 28*c*.

Figure 2:
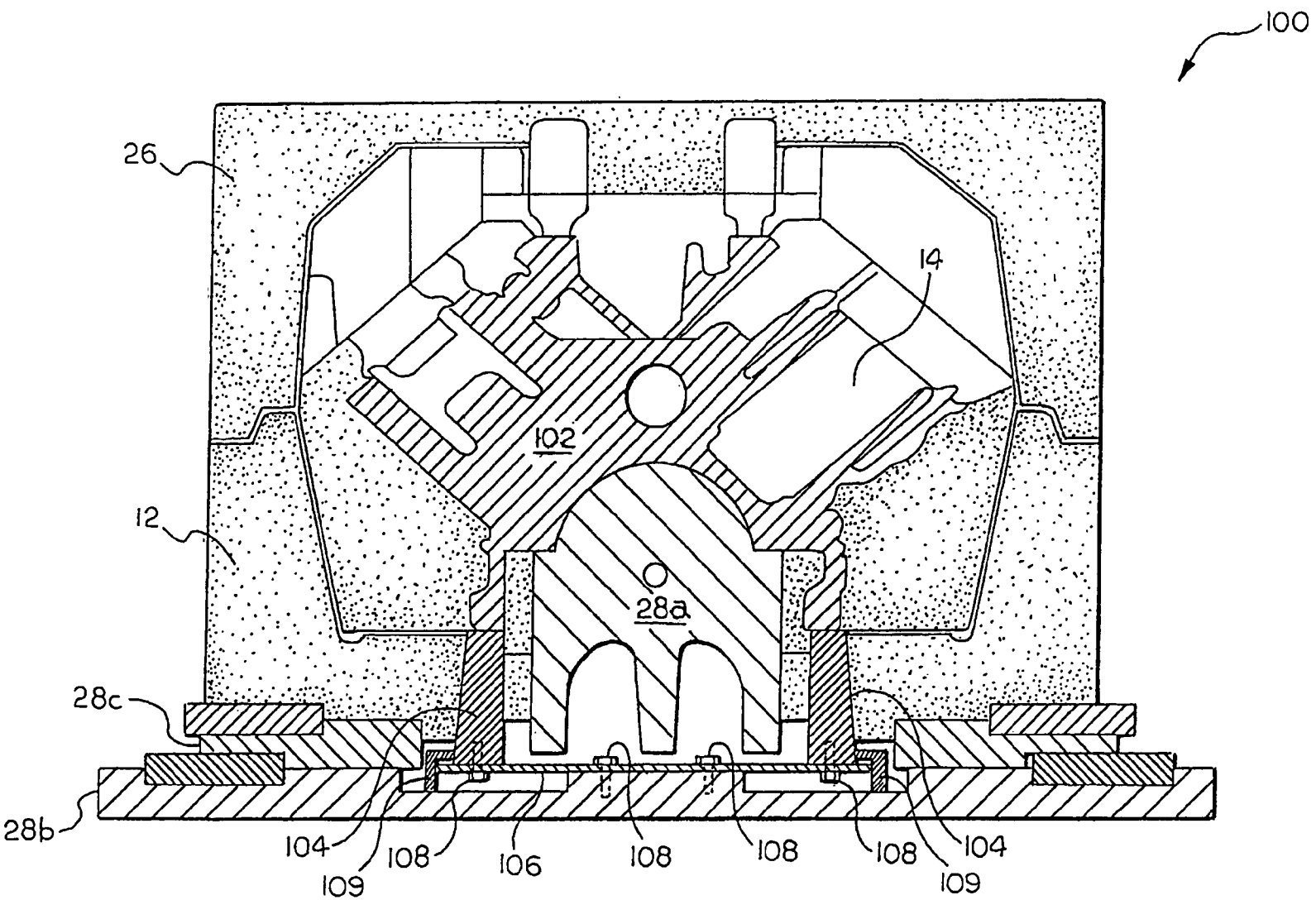
FIG. 2 is a partial sectional view of a mold package according to an embodiment of the invention.
Figure 3:
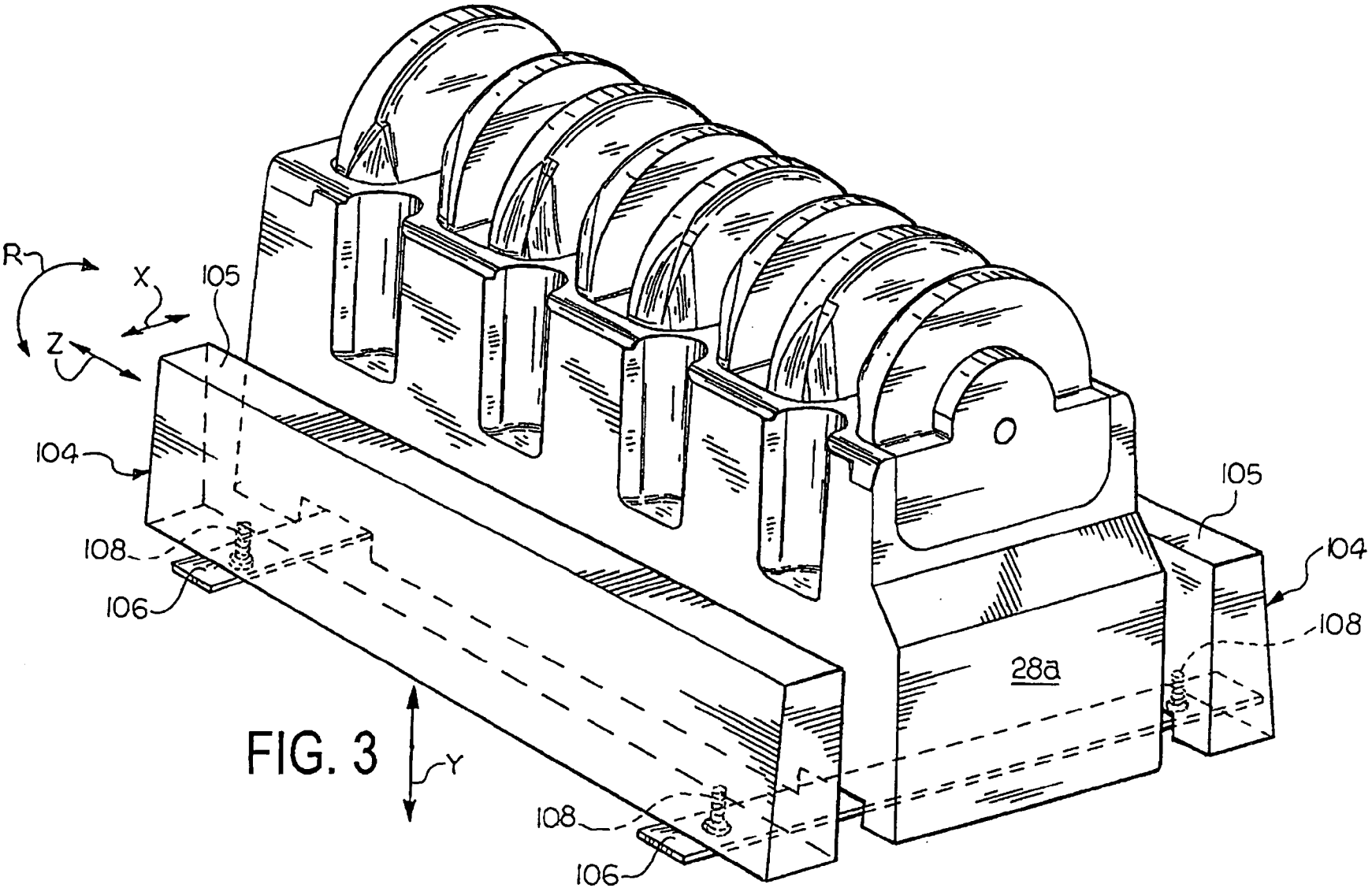
FIG. 3 is a perspective view of the crankcase chill and two pan rail chills shown in FIG. 2.

FIG. 2 shows a sectional view of a mold package 100 according to an embodiment of the invention, after a casting 102 has been formed. Duplicative elements from FIG. 1 have the same reference numerals. A pan rail chill 104 is disposed on each side of the crankcase chill 28*a*. In the embodiment shown, two pan rail chills 104 are shown. However, it is understood that more or fewer pan rail chills 104 can be used. Additionally, the pan rail chills 104 are shown to illustrate an embodiment of the invention. It is understood that other chill types can be used without departing from the scope and spirit of the invention. As illustrated in FIG. 3, each of the pan rail chills 104 is an elongate structure. From a top surface 105 to a bottom surface, the pan rail chills are tapered such that a width thereof increases from the top surface 105 to the bottom surface. The top surface 105 of the pan rail chill 104 shapes an oil pan mounting face (not shown) of the casting 102. The pan rail chills 104 are spaced from the crankcase chill 28*a*.

A leaf spring 106 extends from one pan rail chill 104, under the crankcase chill 28*a*, to the other pan rail chill 104. Although two leaf springs 106 are shown in FIG. 3, more or fewer leaf springs can be used as desired. A pair of leaf springs, one extending outwardly from each side of the crankcase chill 28*a* to respective pan rail chills 104 can also be used. A threaded fastener 108 secures the leaf spring 106 to each of the pan rail chills 104 and the chill plate 28*b*. It is understood that other conventional fastening methods may be used without departing from the scope and spirit of the invention. A removal aid 109 is attached to the chill plate 28*b*. The removal aid 109 extends upwardly from the chill plate 28*b* to engage the leaf spring 106. When removing the chill plate 28*b* from the mold package 100, the removal aid 109 cooperates with the bolts 108 to cause the leaf spring 106 to urge the pan rail chill 104 for removal.

Figure 4:
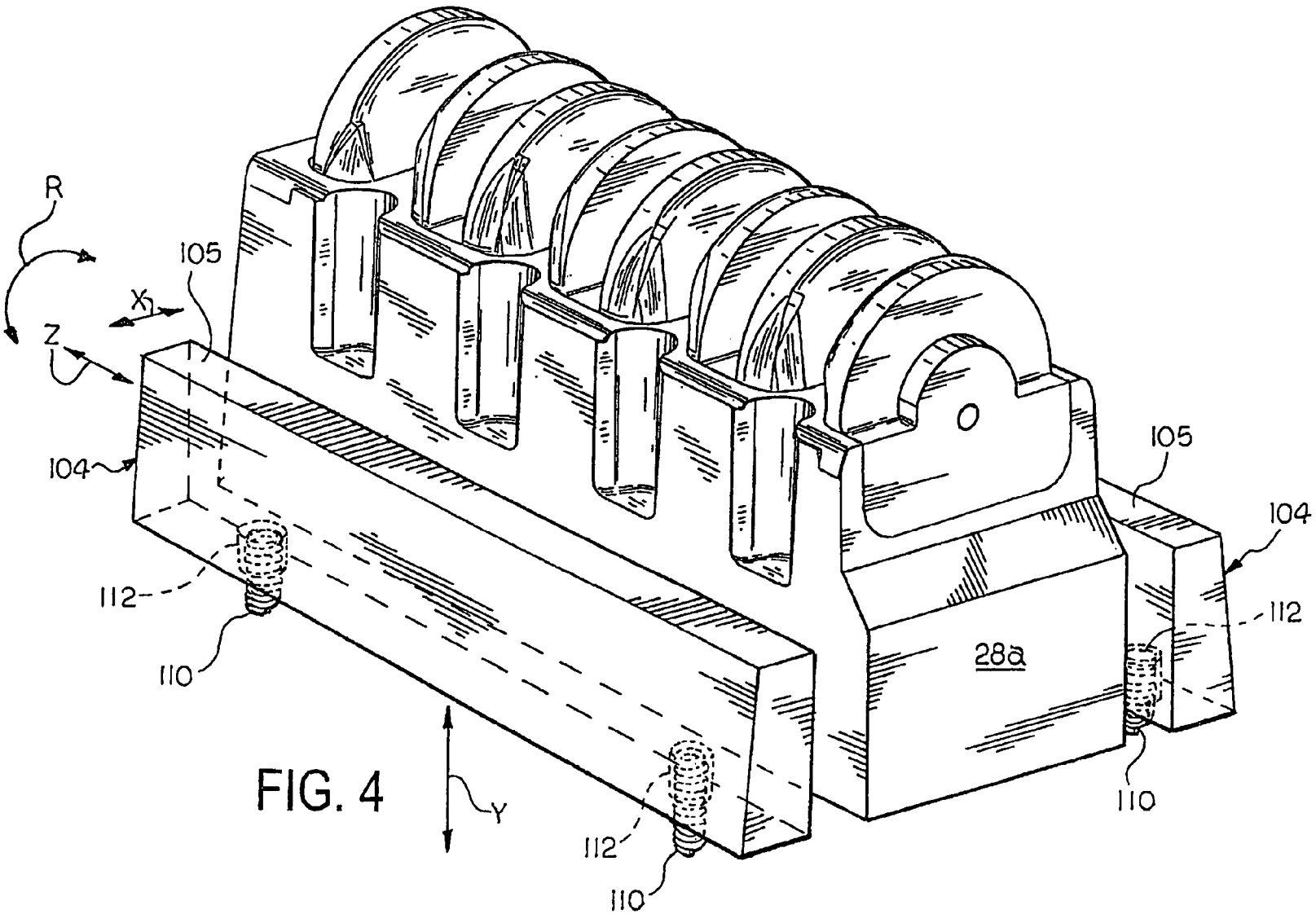
FIG. 4 is a perspective view of a crankcase chill and two rail chills according to another embodiment of the invention.

FIG. 4 shows another embodiment of the invention using coil springs 110 instead of the leaf springs 106. One end of the coil springs 110 are disposed in apertures 112 formed in the pan rail chill 104. The other end of the coil springs 110 is secured to the chill plate 28*b*.

During the casting process, temperature variations occur which cause an expansion and contraction of the materials used to form the casting 102, the chills 28*a*, 104, and the chill plate 28*b*. The chills 28*a*, 104 are caused to expand due to being heated and the casting 102 is caused to contract due to being cooled, resulting in a relative movement therebetween.

The leaf springs 106 secured to the pan rail chills 104 allow for play or movement of the pan rail chills 104. The movement allowed for the pan rail chills 104 combined with the taper of the pan rail chills 104 from top to bottom, facilitates an insertion of the pan rail chills 104 into the core package or subassembly 30. Misalignment of the pan rail chills 104 due to expansion and contraction is also accommodated. The leaf springs 106 allow the pan rail chills 104 to move generally in any coordinate direction as indicated by the arrows X, Y, Z in FIG. 3, although the movement in the Z-direction may be somewhat limited. The pan rail chills 104 are free to rotate about the Z axis as indicated by the rotational arrow R. As the temperature is caused to fluctuate, the pan rail chills 104 are permitted to move as needed by the flexing of the leaf springs 106. The movement permitted by the leaf springs 106 militates against the buildup of undesirable stresses in the casting 102. The coil springs 110 illustrated in FIG. 4 facilitate the same freedom of movement during the temperature fluctuations as indicated by the arrows X, Y, R while increasing the flexibility of the pan rail chills 104 in the Z direction in comparison to the leak spring configuration.

Direct contact of the pan rail chills 104 with the chill plate 28*b* affect the heat transfer characteristics of the pan rail chills 104. The leaf springs 106 provide a thermal buffer or isolation between the pan rail chills 104 and the chill place 28*b* to temper the affect on the heat transfer characteristics of the pan rail chills 104.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A mold for sand casting comprising:

a chill plate adapted to be assembled into a mold package; and at least one chill flexibly supported by said chill plate to allow relative movement therebetween in at least two coordinate directions to facilitate variable positioning of said chill to accommodate expansion and contraction between said chill, said chill plate, and a casting due to temperature fluctuations during a casting process, said chill selectively cooling a portion of the casting.

2. The mold according to claim 1, including at least one spring disposed between said chill plate and said chill.

3. The mold according to claim 2, wherein said spring is a leaf spring.

4. The mold according to claim 2, wherein said spring is a coil spring.

5. The mold according to claim 2, wherein a first end of said spring is secured to said chill plate and a second end of said spring is secured to said chill.

6. The mold according to claim 1, wherein said chill is a pan rail chill.

7. The mold according to claim 1, wherein said chill is tapered to facilitate an insertion thereof into a core package.

8. A mold for sand casting comprising:

a chill plate adapted to be assembled into a mold package;

a chill supported by said chill plate for selectively cooling a portion of a casting; and a spring disposed between said chill plate and said chill to support said chill to allow relative movement in at least two coordinate directions between said chill and said chill plate to facilitate variable positioning of said chill to accommodate expansion and contraction between said chill, said chill plate, and the casting due to temperature fluctuations during a casting process.

9. The mold according to claim 8, wherein said spring is a leaf spring.

10. The mold according to claim 8, wherein said spring is a coil spring.

11. The mold according to claim 8, wherein a first end of said spring is secured to said chill plate and a second end of said spring is secured to said chill.

12. The mold according to claim 8, wherein said chill is a pan rail chill.

13. The mold according to claim 8, wherein said chill is tapered to facilitate an insertion thereof into a core package.

14. A mold for sand casting of an engine cylinder block comprising:

a chill plate;

a mold carrier plate disposed on said chill plate, said mold carrier plate having an aperture formed therein;

a base core supported by said mold carrier plate and adapted to support a core package therein;

a cover core supported by said base core and cooperating with said base core to enclose the core package therein;

a chill supported by said chill plate for selectively cooling a portion of a casting, said chill extending through the aperture to contact the casting, a spring disposed between said chill plate and said chill to support said chill to allow relative movement in at least two coordinate directions between said chill and said chill plate to facilitate variable positioning of said chill to accommodate expansion and contraction between said chill, said chill plate, and the casting due to temperature fluctuations during a casting process.

15. The mold according to claim 14, wherein said spring is a leaf spring.

16. The mold according to claim 14, wherein said spring is a coil spring.

17. The mold according to claim 14, wherein a first end of said spring is secured to said chill plate and a second end of said spring is secured to said chill.

18. The mold according to claim 14, wherein said chill is a pan rail chill.

19. The mold according to claim 14, wherein said chill is tapered to facilitate an insertion thereof into a core package.

* * * * *